United States Patent [19]

Carilli

[11] Patent Number: 4,938,369

[45] Date of Patent: Jul. 3, 1990

[54] MULTIPLE-OPTION TEST TUBE SUPPORT SYSTEM

[76] Inventor: Brian D. Carilli, 2150 Columbia, Palo Alto, Calif. 94306

[21] Appl. No.: 370,643

[22] Filed: Jun. 22, 1989

[51] Int. Cl.[5] ..... A47F 7/00

[52] U.S. Cl. ..... 211/74; 211/60.1

[58] Field of Search ..... 211/74, 60.1, 71, 77

[56] References Cited

U.S. PATENT DOCUMENTS

| | | | |
|---|---|---|---|
| 2,189,989 | 2/1940 | Lichtman | 211/74 |
| 3,233,804 | 2/1966 | Dahm | 211/74 X |
| 3,379,315 | 4/1968 | Broadwin | 211/74 X |
| 3,674,198 | 7/1972 | Eberle | 211/74 X |
| 3,778,232 | 12/1973 | McMorrow | 211/74 X |
| 4,068,798 | 1/1978 | Rohde | 211/74 X |

OTHER PUBLICATIONS

Sargent-Welch Catalog "Supports", pp. 1020-1023, 1971.

Cole-Parmer Catalog, 1989-1990, p. 595, item j, Chicago, Ill., 60648.

VNR Scientific Catalog, 1989-1990, p. 1402, item 60987-008, Philadelphia, PA., 19101-9711.

*Primary Examiner*—Robert W. Gibson, Jr.

*Attorney, Agent, or Firm*—Flehr, Hohbach, Test, Albritton & Herbert

[57] ABSTRACT

A test tube support system wherein support holes of varying sizes are available for simultaneous upright storage of various different sizes of test tubes.

3 Claims, 3 Drawing Sheets

MULTIPLE-OPTION TEST TUBE SUPPORT SYSTEM

BACKGROUND OF THE INVENTION

1. Field of the Invention

The present invention relates generally to a system for the support of test tubes. More specifically, the present invention relates to a system which can simultaneously support test tubes of varying sizes.

2. Description of the Prior Art

In carrying out complex chemical or biological experiments, it is often necessary to deal with many different kinds of liquids within a given time frame. Many of these solutions need to be easily and repeatedly available for sampling. Hence, these materials are usually stored vertically, in upright test tubes. Different sizes of test tube are necessary for storing different types of solutions.

Currently, there are test tube racks available for all of the different sizes of manufactured test tubes. However, in order to cover the needs for any one given experiment, perhaps as many as four different types of test tube racks must be easily within reach, to store the different sizes of test tubes containing the varying chemical solutions. This inefficient use of laboratory benchtop space is a shortcoming of the prior art.

An additional shortcoming of the currently available test tube racks is a requirement for long-term storage of multiple types and sizes of support racks; the different racks can't stack together and hence do not make efficient use of storage space.

A final shortcoming of prior art is that many racks are constructed of materials which cannot withstand extremes of temperature. Chemical solutions often need to be subjected to freezing or boiling, and so test tube racks should have the option of being constructed out of material which is able to withstand these conditions, to prevent the necessity of transferring the solutions to separate containers.

SUMMARY OF THE INVENTION

Accordingly, it is an object of this invention to provide a test tube support system which can be used to support multiple sizes of test tubes simultaneously.

It is another object of the invention to provide a test tube support system which is able to be efficiently stored.

The attainment of these and related objects may be achieved through the use of the novel test tube support system herein disclosed. The advantages and features of the invention should be more readily apparent to those skilled in the art, after review of the following more detailed description of the invention, taken together with the drawings, in which:

DETAILED DESCRIPTION OF THE INVENTION

Turning now to the drawings, two embodiments are represented. The first, illustrated in FIGS. 2–4, consists of four individual multiple-option test tube support modules (MOTTSM) (FIG. 1) contained within a carrying tray. The second, illustrated in FIG. 5, demonstrates a rotatable mechanism which allows four MOTTSM to be attached without the use of a carrying tray.

Figure 1:
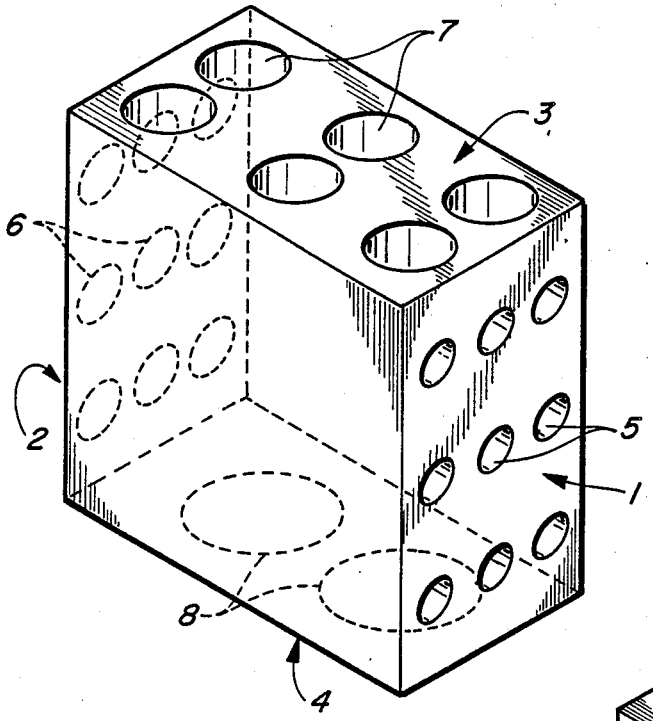
FIG. 1 is a perspective view of an individual module of the multiple-option test tube support system.

Referring to FIG. 1, an individual module (MOTTSM) is a block of homogeneous material, which contains an arrangement of penetrating holes of varying sizes, that will allow support of test tubes of varying sizes. The material used in construction of the MOTTSM may vary with the specific temperature and chemical resistance requirements of a particular application. The suggested dimensions of the MOTTSM, for the most popular current sizes of test tubes in use, are 9 cm×9 cm×5 cm, with hole diameters (5–8) of 1.2 cm for face 1, 1.4 cm for face 2, 1.9 cm for face 3, and 3.3 cm for face 4. The depths of the penetrating holes 5–8 are suggested to be 3.4 cm for face 1, 3.5 cm for face 2, 3.8 cm for face 3, and 2.9 cm for face 4.

Figure 2:
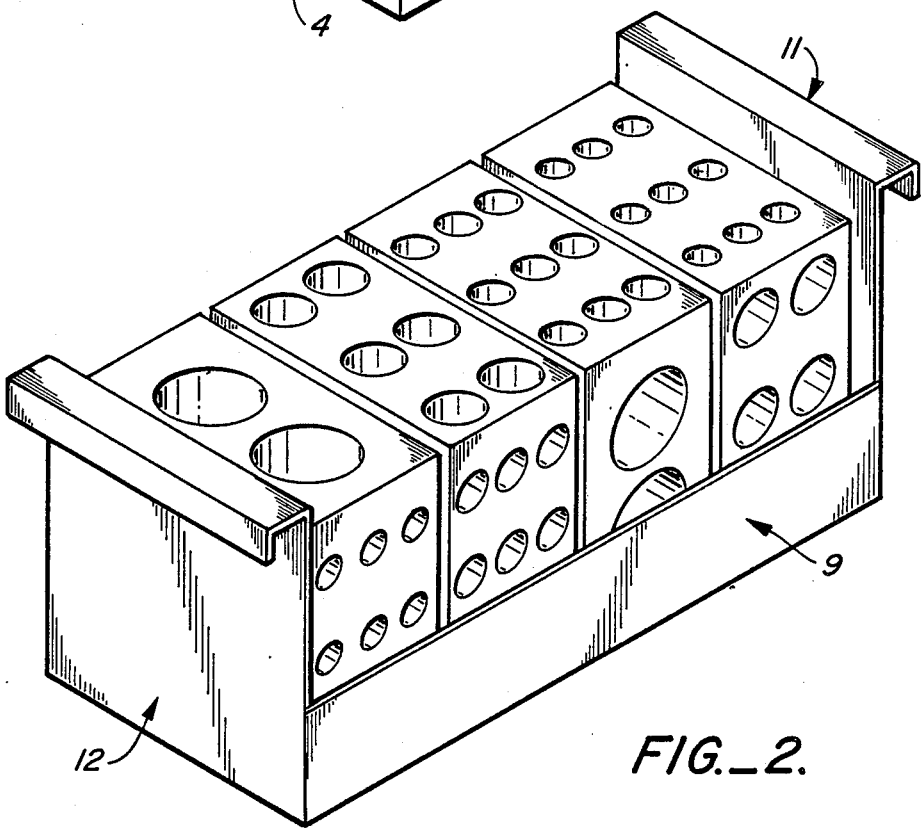
FIG. 2 is a perspective view of four modules contained within a carrying tray according to the preferred embodiment.

Referring to FIG. 2, an orthographic view of the preferred embodiment is presented, where four individual MOTTSMs have been placed into a carrying tray for ease of use. Thus, it is possible to utilize any combination of the four optional sizes of test tube support simultaneously.

Figure 3:
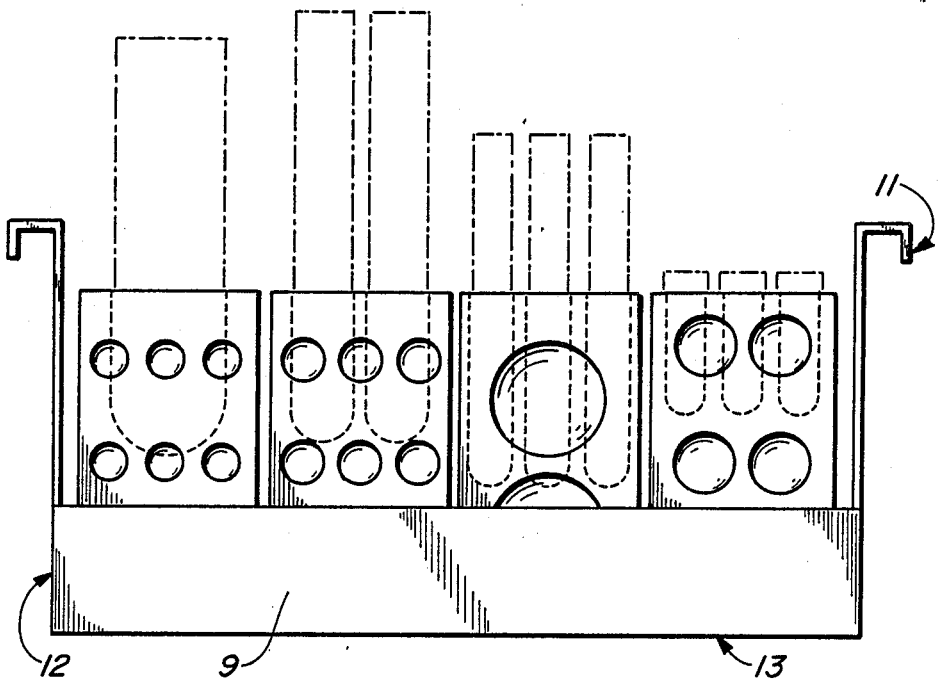
FIG. 3 is a front sectional view of the multiple-option test tube support system according to the preferred embodiment.

Referring to FIG. 3, the suggested dimensions of the carrying tray are approximately 20.5 cm×9.3 cm, with a height of 4 cm along the length 9 and 10, and a height of 11 cm along the width 11 and 12. The sides 11 and 12 include a lip for ease of carrying, of approximate dimensions 1.4 cm×1 cm. An advantage of this embodiment is that the carrying trays and MOTTSMs are of uniform size and hence easily stackable for storage.

Figure 4:
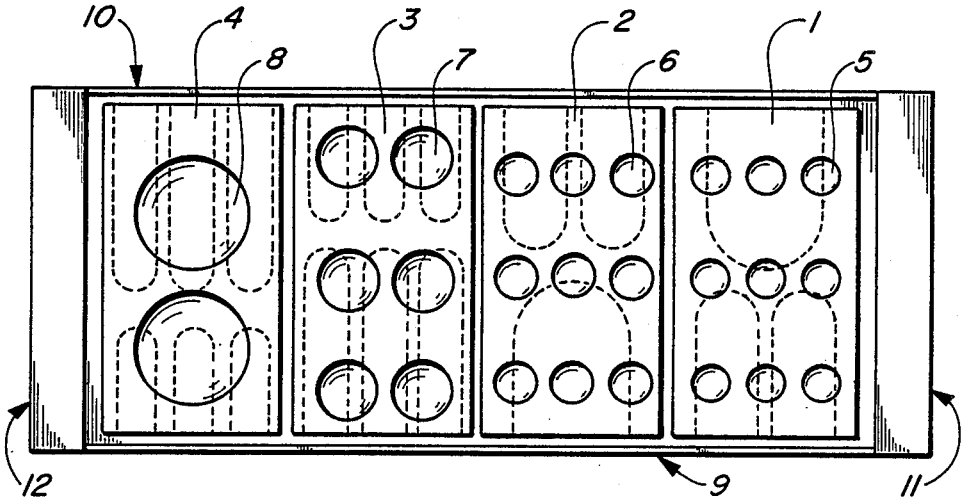
FIG. 4 is a top sectional view of the multiple-option test tube support system according to the preferred embodiment.

Referring to FIG. 4, it can be seen that each individual MOTTSM is separate from the other MOTTSMs. This provides an additional advantage of this embodiment, in that any of the four units can be removed and, if desired, rotated, to either allow exposure of a different size of support hole, or transport of an individual unit to another location independent of the other MOTTSMs. This is a vast improvement over the prior art method of using separate large test tube support racks for removing a small number of test tubes from another group, or for times when changing needs require a new size of support hole.

Figure 5:
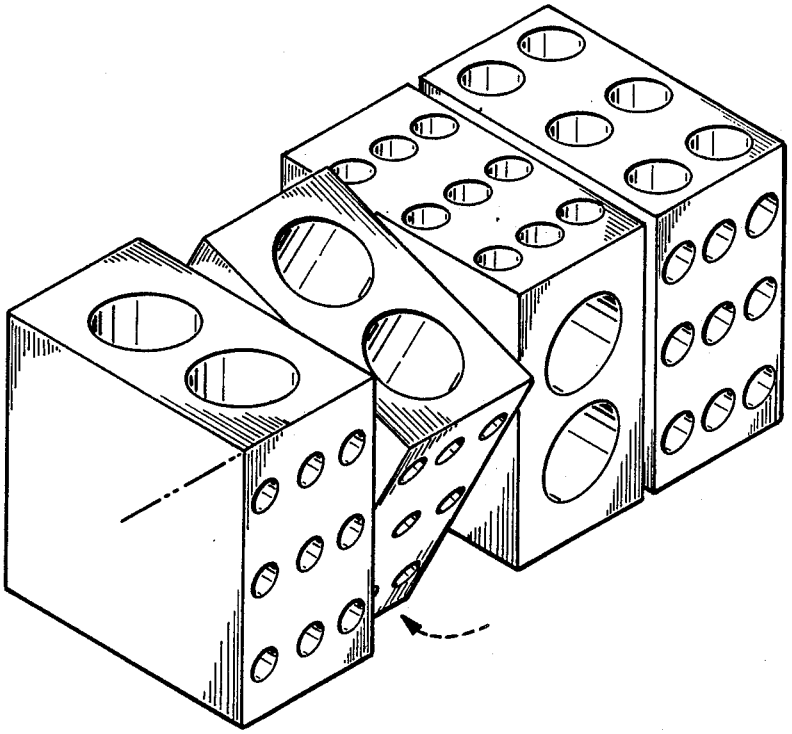
FIG. 5 is a perspective view of an alternative embodiment of the preferred embodiment wherein a rotatable mechanism replaces the need for a carrying tray for individual modules.

Turning now to FIG. 5, an alternate embodiment of the multiple-option test tube support system is shown. The embodiment in FIG. 5 is to be used when it is anticipated that all four units will be used routinely, without need to remove one from the others. The embodiment allows the units to be attached to one another without recourse to an additional piece of equipment (the separate carrying tray). FIG. 5 includes a partially rotated module for ease of interpretation. The mechanism comprises a central axis around which the modules can rotate, and a means for locking the units into the desired configuration.

It should be further apparent to those skilled in the art that various changes in form and details of the invention as shown and described may be made. It is intended that such changes be included within the spirit and scope of the claims appended hereto.

What is claimed is:

1. A test tube support system, comprising:

a plurality of rectangular box-shaped units each having six faces, a multiplicity of said faces in each said unit having a plurality of holes of various diameters, each said hole having sufficient depth to prevent tipping of test-tubes stored vertically therein; and support means for holding said plurality of units, wherein each of said units may be differently oriented so that test tubes of various sizes may be stored in said test tube support system.

2. The test tube support system of claim 1, wherein each of said multiplicity of faces has holes of a different diameter.

3. A test tube support system, comprising:

a plurality of rectangular box-shaped units each having six faces, a multiplicity of said faces in each said unit having a plurality of holes of various diameters, each said hole having sufficient depth to prevent tipping of test-tubes stored vertically therein;

wherein said plurality of units are attached along a common central axis so that each unit may be separately rotated about said central axis.

* * * * *